US006196305B1

(12) United States Patent
Geiger

(10) Patent No.: US 6,196,305 B1
(45) Date of Patent: Mar. 6, 2001

(54) RADIATOR ASSEMBLY

(75) Inventor: Karl Erwin Geiger, Dearborn Heights, MI (US)

(73) Assignee: Great Lakes, Inc., Van Buren Township, MI (US)

( * ) Notice: Subject to any disclaimer, the term of this patent is extended or adjusted under 35 U.S.C. 154(b) by 0 days.

(21) Appl. No.: 08/401,347

(22) Filed: Mar. 9, 1995

(51) Int. Cl.[7] ..... F28D 1/00
(52) U.S. Cl. ..... 165/149; 165/173; 165/906
(58) Field of Search ..... 165/149, 151, 165/153, 148, 173, 906

(56) References Cited

U.S. PATENT DOCUMENTS

| | | | | |
|---|---|---|---|---|
| 2,164,628 | * | 7/1939 | Sibley | 165/173 |
| 2,260,638 | * | 10/1941 | Pfost | 165/149 |
| 2,375,999 | * | 5/1945 | Miller | 165/173 |
| 3,027,142 | * | 3/1962 | Alberts et al. | 165/906 X |
| 3,245,465 | * | 4/1966 | Young | 165/173 X |
| 3,581,814 | * | 6/1971 | Jackson | 165/148 X |
| 3,710,858 | * | 1/1973 | Young | 165/173 X |
| 3,989,103 | * | 11/1976 | Cieszko et al. | 165/149 X |
| 4,756,361 | * | 7/1988 | Lesage | 165/149 |
| 4,926,934 | * | 5/1990 | Ivy | 165/173 |
| 4,997,035 | * | 3/1991 | Beatenbough et al. | 165/149 X |
| 5,203,407 | | 4/1993 | Nagasaka | 165/174 |
| 5,257,662 | * | 11/1993 | Osborn | 165/149 X |

FOREIGN PATENT DOCUMENTS

| | | | | |
|---|---|---|---|---|
| 432080 | * | 7/1935 | (GB) | 165/149 |
| 488130 | * | 12/1953 | (IT) | 165/149 |
| 0055684 | * | 4/1983 | (JP) | 165/149 |

* cited by examiner

*Primary Examiner*—Christopher Atkinson
(74) *Attorney, Agent, or Firm*—Bliss McGlynn, P.C.

(57) ABSTRACT

A radiator assembly for a cooling system on an internal combustion engine includes a radiator core having a plurality of tube-flow passages for transferring heat from fluid coolant to ambient atmosphere and at least one tank in fluid communication between an internal combustion engine and the radiator core. The radiator core includes a header flange extending about at least a portion of a perimeter of the radiator core and the tank includes a clamping flange extending about at least a portion of a perimeter of the tank corresponding to and in adjacent relationship with the header flange of the radiator core. The radiator assembly also includes an improved fastening mechanism for fixedly securing the tank to the radiator core so as to prevent leakage from the radiator assembly between the tank and the radiator core by applying a pair of clamping forces acting on both the header flange on the radiator core and the clamping flange on the tank orthogonal to the flanges and in opposite directions relative to each other.

11 Claims, 2 Drawing Sheets

10
3
20
14

30
12
26
4
28
3
18
50
20
22
24
16
4
14
32
26
18
50

52
50
54
48
44
16
18
14
48
38
48
42
40

48
34
36
26
48
46
58
56

RADIATOR ASSEMBLY

BACKGROUND OF THE INVENTION

1. Field of the Invention

The present invention relates generally to cooling systems for heavy duty truck engines and, more specifically, to a radiator assembly for a cooling system for a heavy duty truck engine.

2. Description of the Related Art

Internal combustion engines generate heat which must be dissipated or otherwise transferred from the engine to a heat sink such as ambient air surrounding the engine and its components. In a motor vehicle, a cooling system is the heat sink for the engine. Motor vehicle cooling systems typically include flow passages for fluid coolant which passes through a cooling jacket portion of an engine block for the engine and the flow passages are coupled in fluid coolant communication with a fluid coolant reservoir through hoses or the like. Fluid coolant reservoirs are commonly referred to as radiators and transfer heat from fluid coolant in the cooling system to the ambient atmosphere through a plurality of heat transfer mechanisms in a core of the radiator. More specifically, such radiators typically include a radiator core having a pair of tanks fixedly secured to either end thereof. Such radiators usually employ a gasket at the juncture between the tanks and the radiator core to facilitate fluid communication from one tank to the radiator core and from the radiator core to another tank as heat is transferred from fluid coolant in the cooling system to the ambient atmosphere surrounding the radiator.

Certain motor vehicles require greater cooling requirements than others. For example, the engines employed in freight vehicles of all sizes and especially those used in heavy duty trucks have substantial cooling requirements. Such vehicles typically operate using compression ignition or diesel engines and are designed for relatively long operating lives. Unfortunately and despite the longevity of such engines, the cooling systems employed and specifically the radiators employed have not enjoyed comparable operating life spans. Specifically, it is not uncommon for the plastic tanks on such radiators to fail under the repeated cycling of fluid coolant at elevated temperatures and pressures. Such failures include hairline cracks in the stress points of the tanks and broken bleeder flanges and petcocks and oblong flanges due to excessive clamping of hoses to prevent coolant seepage. Further, such radiators often employ inferior fastening mechanisms at the tank/header juncture. These fastening mechanisms include a plurality of crimp tabs disposed along a perimeter of the header. However, these crimp tabs become stressed and weakened due to excessive retightening, thus allowing fluid coolant to leak over time and leading to tank/header separation. Such fluid coolant leaks ultimately result in loss of fluid coolant, which, if undetected, can also lead to engine overheating, cracked engine blocks and blown head gaskets. More importantly, such fluid coolant leaks can result in higher down time costs and loss of income for such vehicles.

SUMMARY OF THE INVENTION

It is, therefore, one object of the present invention to provide an improved steel tank radiator assembly replacing a plastic crimp tab radiator assembly for a cooling system on an internal combustion engine.

It is another object of the present invention to provide a radiator assembly with an improved fastening mechanism.

To achieve the foregoing objects, the present invention is a radiator assembly for a cooling system on an internal combustion engine including a radiator core having a plurality of tube-flow passages for transferring heat from a fluid coolant to ambient atmosphere and at least one tank in fluid communication between the internal combustion engine and the radiator core. The radiator core includes a header flange extending about at least a portion of a perimeter of one end of the radiator core. The tank includes a clamp flange extending about at least a portion of a perimeter of the tank corresponding to and in adjacent relationship with the header flange of the radiator core. The radiator assembly further includes an improved fastening mechanism for fixedly securing the tank to the radiator core so as to resist leakage from the radiator assembly between the tank and the radiator core by applying a pair of clamping forces acting on both the header flange of the radiator core and the corresponding clamping flange on the tank orthogonal to these flanges and in opposite directions relative to each other.

One advantage of the present invention is that a radiator assembly is provided for a cooling system on heavy duty truck engines. Another advantage of the present invention is that the radiator assembly has an improved fastening mechanism which securely attaches a tank to a radiator core and which substantially improves the leak resistant characteristics of the radiator assembly over crimp tab fastening mechanisms. Yet another advantage of the present invention is that the radiator assembly is more efficient and cost effective than such conventional radiator assemblies in that the number of tanks to header separations and leakages are reduced, thereby reducing vehicle operating down time and avoiding serious and costly engine repairs due to the inadvertent and unexpected loss of fluid coolant through a failed radiator.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
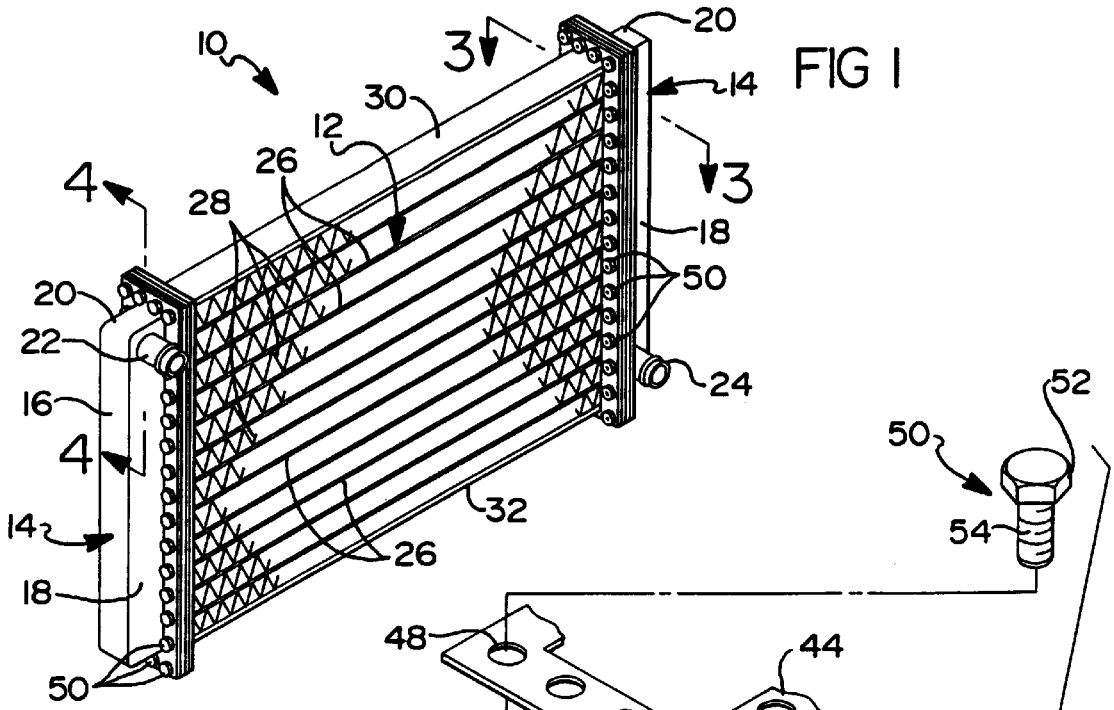
FIG. 1 is a perspective view of a radiator assembly according to the present invention.

Referring to FIG. 1, one embodiment of a radiator assembly 10, according to the present invention, is shown for a cooling system (not shown) on an internal combustion engine (not shown) such as a heavy duty truck engine. The radiator assembly 10 includes a radiator core, generally indicated at 12, and at least one, but preferably a plurality of tanks 14 disposed at either end of the radiator core 12. The tanks 14 provide fluid communication via hoses (not shown) between the internal combustion engine and the radiator core 12.

Figure 3:
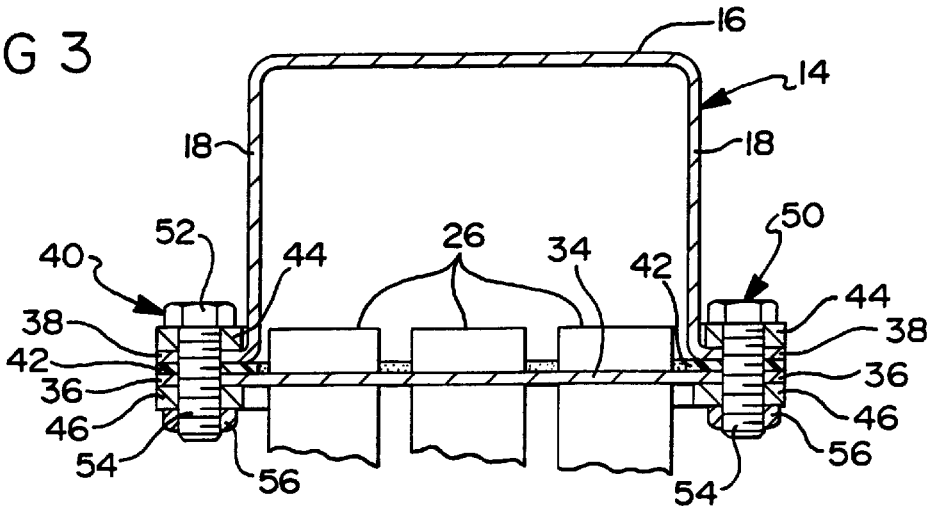
FIG. 3 is a sectional view taken along line 3—3 of FIG. 1.
Figure 4:
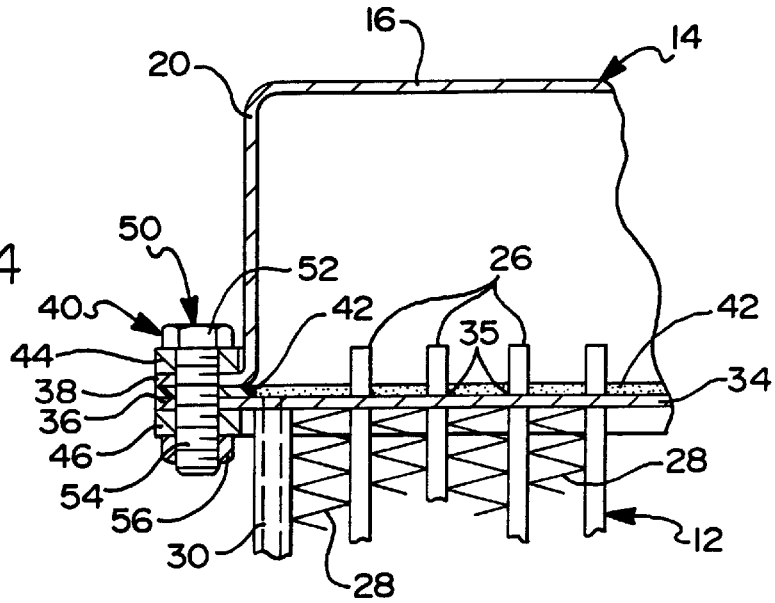
FIG. 4 is a partial sectional view taken along line 4—4 of FIG. 1.

In one embodiment, the tanks 14 are made of metal material such as steel and have a substantially U-shaped configuration in cross section as illustrated in FIGS. 3 and 4. More specifically, the tanks 14 include a top wall 16, a pair of side walls 18 disposed opposite and in spaced relation relative to one another and a pair of end walls 20 also opposite and spaced relative to one another and extending between the sidewalls 18. As illustrated in FIG. 1, an inlet connection 22 is provided in one tank 14 and an outlet connection 24 is provided in the other. Both the inlet connection 22 and outlet connection 24 are in fluid communication via hoses with the internal combustion engine such that fluid coolant may flow from the engine at an elevated temperature through the hoses and radiator assembly 10 and then back to the engine at a lower temperature having transferred a portion of the heat from the engine to the ambient atmosphere.

The radiator core 12 includes a plurality of tube-flow passages 26 in a predetermined number of rows such as three and spaced relative to one another in adjacent rows as illustrated in FIGS. 3 and 4. The tube-flow passages 26 provide fluid communication between the tanks 14 through the radiator core 12. The radiator core 12 also includes fins 28 extending the length of the radiator core 12 and between adjacent rows of tube-flow passages 26 for transferring heat from the fluid coolant passing through the tube-flow passages 26 to the fins 28 and then to the ambient air which flows past the fins 28 and tube-flow passages 26.

The radiator core 12 further includes a pair of side plates 30, 32 extending along sides of the radiator core 12 and between the tanks 14. The radiator core 12 also includes a header plate 34 disposed at each end of the radiator core 12 and is secured to the radiator core 12 by suitable means such as soldering. Each header plate 34 includes a plurality of apertures for receiving the tube-flow passages 26 extending through the radiator core 12. Each header plate 34 includes a corner reinforcement plate 35 at each end with a plurality of apertures for receiving the tube-flow passages 26. The corner reinforcement plates 35 protect the tube-flow passages 26 and header plate 34 from failure at a critical stress point. Each header plate 34 further includes a header flange 36 extending about at least a portion of a perimeter of the radiator core 12. In one embodiment, the header flange 36 on the header plate 34 extends about the entire perimeter of the radiator core 12 at either end thereof.

Similarly, the tanks 14 have a clamping flange 38 extending about at least a portion of a perimeter of the tanks 14 and corresponding to and in adjacent relationship with the header flange 36 on the header plate 34. In one embodiment, the clamping flange 38 extends about the entire perimeter of the open end of the tanks 14 so as to be corresponding with and in adjacent relationship with the header flange 36 of the header plate 34.

Figure 2:
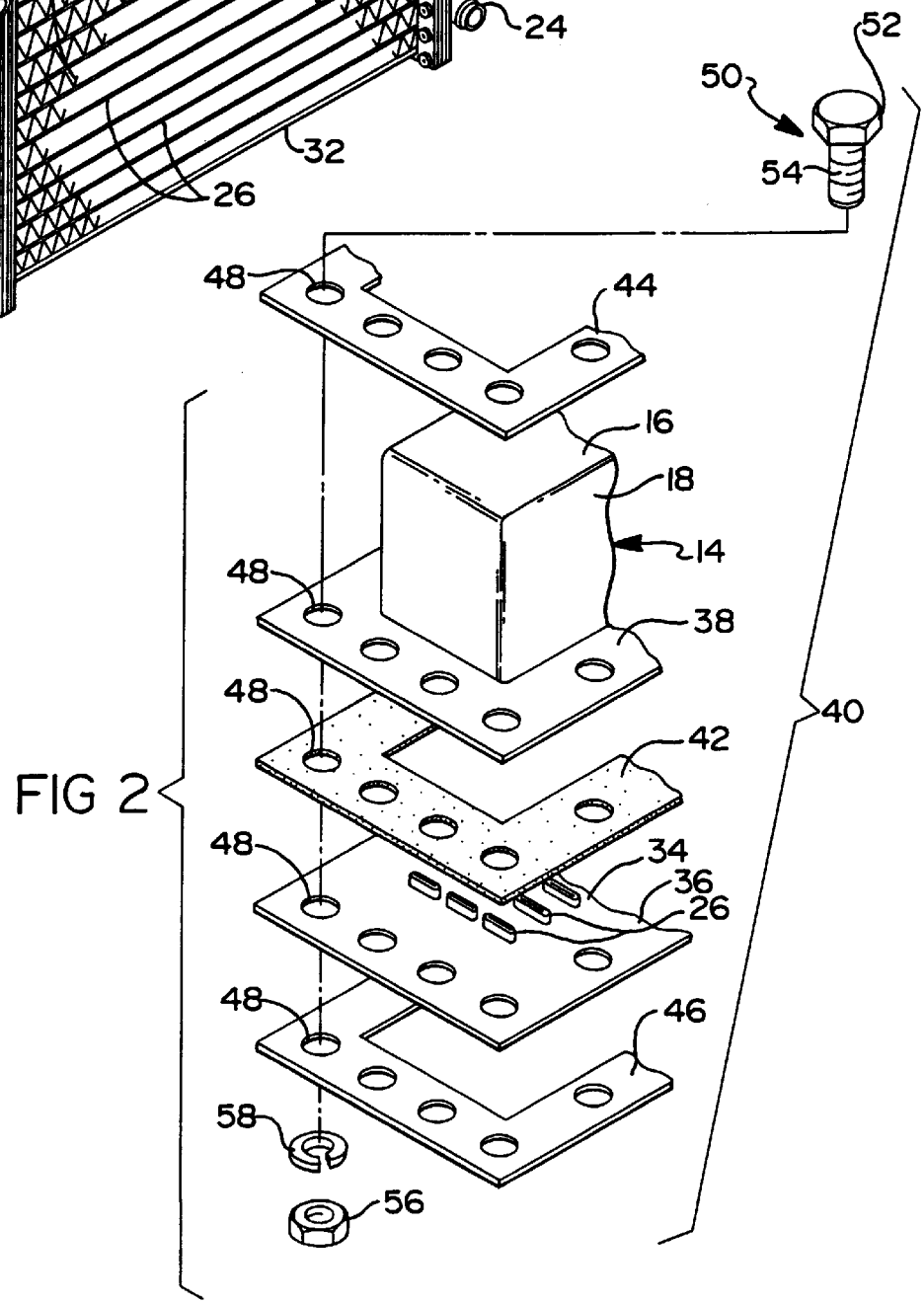
FIG. 2 is an exploded view of a fastening mechanism for the radiator assembly of FIG. 1.

Referring to FIGS. 2, 3 and 4, the radiator assembly 10 includes an improved fastening mechanism, generally indicated at 40, for fixedly securing the tanks 14 to the radiator core 12 so as to resist fluid coolant leakage from the radiator assembly 10 between the tanks 14 and the radiator core 12. The fastening mechanism 40 applies a pair of clamping forces acting on both the header flange 36 on the header plate 34 and the corresponding clamping flange 38 on the tanks 14. These clamping forces are orthogonal to the flanges 36, 38 and in the opposite direction relative to each other. The fastening mechanism 40 includes a gasket 42 disposed between the flanges 36, 38 on the header plate 34 and the tanks 14, respectively. Further, the fastening mechanism 40 includes tank torque plates 44 associated with the clamping flanges 38 of the tanks 14. More specifically, the tank torque plates 44 also extend about the entire perimeter of the open end of the tanks 14 and in abutting relation to the clamping flanges 38. Similarly, the fastening mechanism 40 includes header torque plates 46 associated with the header plates 34 of the radiator core 12 and also extend about the entire perimeter of the radiator core 12 at either end thereof and in abutting relation to the flanges 36. The pair of opposed orthogonal clamping forces act on the flanges 36, 38 through the torque plates 44, 46.

The header flanges 36 on the header plate 34 and the clamping flanges 38 on the tanks 14 as well as the gaskets 42 and torque plates 44, 46 each include a plurality of aligned apertures 48 as illustrated in FIG. 2. The fastening mechanism 40 further includes a plurality of fasteners, generally indicated at 50. The fasteners 50 are bolts and each include a head 52 and a threaded shaft 54 extending through aligned apertures 48 with a nut 56 threaded on the shaft 54. The head 52 and nut 56 apply the pair of orthogonal clamping forces acting on the flanges 36, 38, the gaskets 42 and the torque plates 44, 46 in opposite directions relative to each other. More specifically, the head 52 of the fastener 50 acts on the tank torque plates 44 and creates one of the pair of clamping forces and the nut 56 of the fastener 50 acts on the header torque plates 46 and thereby creates the other of the pair of clamping forces. The fastening mechanism 40 also includes a lock washer 58 clamped between the nut 56 and the header torque plate 46.

Figure 5:
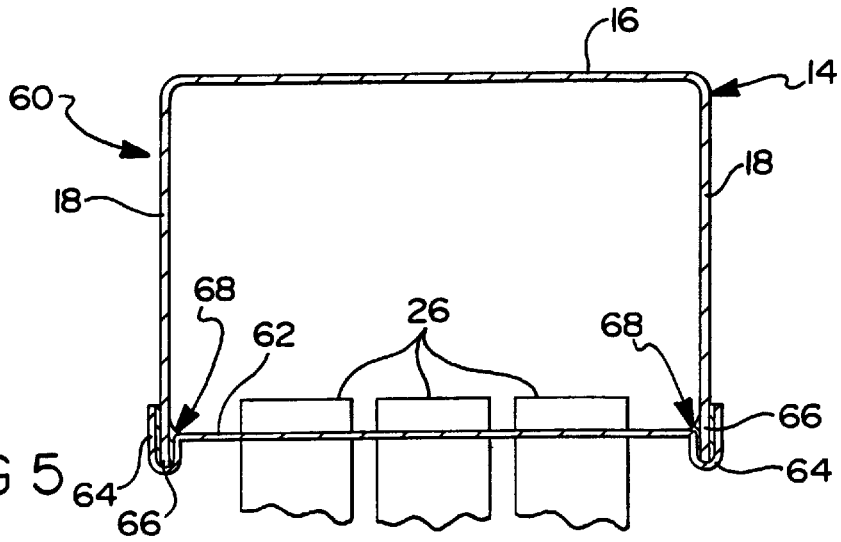
FIG. 5 is a sectional end view illustrating an alternate embodiment of the radiator assembly of FIG. 1.

Referring to FIG. 5, an alternative embodiment of the radiator assembly 10, according to the present invention, is generally shown at 60 wherein like numerals are used to designate like structure. The header plate 62 on the radiator core 12 includes a U-shaped flange 64 extending about at least a portion of a perimeter of one end of the radiator core 12. In one embodiment, however, the U-shaped flange 64 of the header plate 62 extends around the entire perimeter of both ends of the radiator core 12. Instead of the flanges 38, the tanks 14 include terminal ends 66 on the side and end walls 18, 20. The terminal ends 66 are received in the U-shaped flange 64 on the header plate 62 of the radiator core 12. A fastening mechanism, generally indicated at 68, for fixedly securing the tank 14 to the radiator core 12 so as to prevent leakage from the radiator assembly 60 between the tanks 14 and the radiator core 12. The fastening mechanism 68 includes a bonding agent disposed at the juncture of the U-shaped flange 64 on the header plate 62 and the terminal ends 66 of the side and end walls 18, 20 of the tanks 14. In one embodiment, the bonding agent 68 is a solder but may also be any other type of weld.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A radiator assembly for a cooling system on an internal combustion engine comprising:

a radiator core having a plurality of tube-flow passages for transferring heat from fluid coolant to ambient atmosphere and at least one tank in fluid communication between an internal combustion engine and said radiator core;

said radiator core including a unitary, flat header flange extending continuously about an entire perimeter of one end of said radiator core;

said at least one tank having a unitary, flat clamping flange extending continuously about an entire perimeter of said at least one tank corresponding to and in adjacent relationship with said header flange of said radiator core and a gasket disposed between said clamping flange and said header flange; and an improved fastening mechanism for fixedly securing said at least one tank to said radiator core so as to resist fluid coolant leakage from said radiator assembly between said at least one tank and said radiator core, said improved fastening mechanism including a unitary, flat tank torque plate extending continuously about the entire perimeter of said at least one tank and disposed in mating relationship with said clamping flange of said at least one tank and a unitary, flat header torque plate extending continuously about the entire perimeter of one end of said radiator core and disposed in mating relationship with said header flange, said header flange and said clamping flange as well as said gasket and said torque plates each including a plurality of aligned apertures, said improved fastening mechanism further including a plurality of fasteners each including a head and a threaded shaft extending through said aligned apertures and a nut threaded on said shaft, said head and said nut applying a pair of clamping forces acting on both said header flange on said radiator core and said clamping flange on said tank through said header torque plate, said gasket and said tank torque plate orthogonal to said flanges and in opposite directions relative to each other.

2. A radiator assembly as set forth in claim 1 wherein said head of said fastener acts on said tank torque plate and creates one of said pair of clamping forces and said nut of said fastener acts on said header torque plate and creates the other of said pair of clamping forces.

3. A radiator assembly as set forth in claim 1 wherein said improved fastening mechanism includes a lock washer clamped between said nut and said radiator torque plate.

4. A radiator assembly as set forth in claim 1 including a pair of tanks fixedly secured to opposite ends of said radiator core by said improved fastening mechanism to facilitate flow of fluid coolant into said radiator assembly, through one of said tanks, through said tube-flow passages into the other of said tanks and then out said radiator assembly.

5. A radiator assembly as set forth in claim 4 wherein said radiator core includes a pair of side plates extending along the sides of said radiator core and between said pair of tanks.

6. A radiator assembly as set forth in claim 5 wherein said radiator core includes header plates disposed at either end thereof, each of said header plates presenting said header flange extending about the entire perimeter of said radiator core.

7. A radiator assembly as set forth in claim 6 wherein said tanks have a substantially U-shaped configuration in cross-section defining an open end with said clamping flange extending about the entire perimeter of said open end of each of said tanks so as to be corresponding with and in adjacent relationship with said header flanges of said header plates, a tank torque plate disposed in mating relationship with each clamping flange and a header torque plate disposed in mating relationship with each header flange.

8. A radiator assembly as set forth in claim 7 wherein said header includes a plurality of apertures for receiving said plurality of tube-flow passages extending through said radiator core.

9. A radiator assembly as set forth in claim 7 wherein said header plate includes a corner reinforcement plate at each end with a plurality of apertures for receiving said plurality of tube-flow passages extending through said radiator core.

10. A radiator assembly as set forth in claim 8 wherein said plurality of tube-flow passages are spaced relative to one another and wherein said radiator core includes fins extending through said core and between said adjacent tube-flow passages for transferring heat from fluid coolant passing through said tube-flow passages to said fins and then to the ambient atmosphere.

11. A radiator assembly:

a radiator core having a plurality of tube-flow passages for transferring heat from fluid coolant to the ambient atmosphere and a pair of tanks disposed at opposite ends of said radiator core and in fluid communication between an internal combustion engine and said radiator core to facilitate the flow of fluid coolant into said radiator assembly, through one of said tanks, through said tube-flow passages into the other of said tanks and then out said radiator assembly;

said radiator core including a pair of header plates disposed at either end thereof, each of said header plates presenting a unitary, flat header flange extending continuously about the entire perimeter of said radiator core at either end thereof;

each of said tanks having a unitary, flat clamping flange extending continuously about the entire perimeter of said tanks corresponding to and in adjacent relationship with each of said header flanges of said header plates and a gasket disposed between said clamping flanges and said header flanges; and an improved fastening mechanism for fixedly securing said tanks to said radiator core so as to prevent leakage from said radiator assembly between said tanks and said radiator core, said improved fastening mechanism including a unitary, flat tank torque plate extending about the entire perimeter of each of said tanks and disposed in mating relationship with each of said clamping flanges of said tanks and a pair of unitary, flat header torque plates extending about the entire perimeter at both ends of said radiator core and disposed in mating relationship with said header flanges, said header flanges on said header plates and said clamping flanges on said tanks as well as said gasket and said torque plates each including a plurality of aligned apertures and said improved fastening mechanism including a plurality of fasteners each including a head and a threaded shaft extending through said aligned apertures and a nut threaded on said shaft, each head and nut applying a pair of clamping forces acting on both said header flanges on said header plates and said corresponding clamping flanges on said tanks through said header torque plates and said tank torque plates orthogonal to said flanges and in the opposite direction relative to each other.

* * * * *